United States Patent [19]

Roach

[11] 4,333,066

[45] Jun. 1, 1982

[54] POSITION TRANSDUCER

[75] Inventor: Charles D. Roach, Newport News, Va.

[73] Assignee: The United States of America as represented by the Secretary of the Army, Washington, D.C.

[21] Appl. No.: 166,652

[22] Filed: Jul. 7, 1980

[51] Int. Cl.[3] ..... H01H 36/00

[52] U.S. Cl. ..... 335/206; 335/280

[58] Field of Search ..... 335/206, 205, 207, 280, 335/203; 324/208; 340/870.32, 870.31

[56] References Cited

U.S. PATENT DOCUMENTS

| | | | |
|---|---|---|---|
| 2,668,884 | 2/1954 | Jacobs | 335/280 |
| 2,917,599 | 12/1959 | Ovshinsky | 335/280 |
| 2,966,567 | 12/1960 | Ovshinsky | 335/280 |
| 3,200,216 | 8/1965 | Deutschman | 335/280 |
| 3,488,578 | 1/1970 | Stigmark | 324/208 |
| 4,100,485 | 5/1978 | Rogers | 340/870.32 |
| 4,165,501 | 8/1979 | Bongort | 335/206 |

*Primary Examiner*—Harold Broome

*Attorney, Agent, or Firm*—Nathan Edelberg; Louis Allahut; Norman L. Wilson, Jr.

[57] ABSTRACT

An electrical transducer for indicating the position of an element movable in a predictable path, such as angular rotation, has no electrical parts on the movable element. A magnet mounted to the movable element traces a fixed path which lies adjacent to a stationary tubular enclosure containing liquid suspending a mass of ferromagnetic, electrically conductive material, the magnet drawing the mass of particles along within the tube on movement in its fixed path. Electrodes spaced on opposite sides of the tube wall along the length of the tube are electrically coupled by the mass of particles, whereby to indicate the position of the movable element.

11 Claims, 3 Drawing Figures

POSITION TRANSDUCER

BACKGROUND OF THE INVENTION

The present invention relates to a transducer for indicating the position of a movable element which moves in a predictable path, for example, to indicate the angular position of a rotatable object or the linear position of an object movable along a linear path.

In the prior art, one general type of electrical transducer for indicating the position of an object utilizes a brush-type contact, fixed to the movable object, to slidably contact one of a plurality of fixed contacts on a stationary object positioned along the path of the movable object.

To set up an electrical circuit, the movable object must also be provided with a voltage supply and/or a return lead; provision of this circuitry on the moving element is not always desirable or preferable. Furthermore, the system is subject to failure due to wear of the brush-type contact.

SUMMARY OF THE INVENTION

The principal purpose of the present invention is to provide a position-indicating electrical transducer for which no electrical apparatus is mounted on the movable element whose position is to be monitored.

Briefly summarized, the present invention includes a permanent magnet (or magnets) mounted to the movable element so as to trace a fixed path on movement of the element. An enclosed tube or conduit is mounted in fixed position apart from the movable element, extending adjacent to the fixed path traced by the magnet. The tube contains a liquid which includes suspended particles of ferromagnetic, electrically-conductive material which are agglomerated in the presence of the field of the magnet and are drawn along within the tube by the magnet as it traces its fixed path. Electrode means in the tube include a continuous bus electrode mounted on the inner side of the wall of the tube, extending substantially the length of the tube. Spaced transversely of the bus electrode in the tube wall and likewise extending the length of the tube, a chain of spaced-apart position-indicating electrodes permit monitoring the positon of the ferromagnetic particles, which provide electrical coupling between the bus electrode and one or several adjacent position-indicating electrodes. In an alternative embodiment, the bus electrode is instead spaced transversely from a resistive electrode having a single lead; the position of the element is then a function of the resistance between the bus electrode and the lead of the resistive electrode.

Where the purpose is to indicate the angular position of a rotatable element, the magnet is mounted spaced from the axis of rotation of the element and the tube is formed into a toroid-shaped enclosure.

DESCRIPTION OF A PREFERRED EMBODIMENT

The present invention is an electrical transducer for use in indicating the position of a movable object which moves in a predictable path, such as angularly about an axis of rotation, or linearly.

Figure 1:
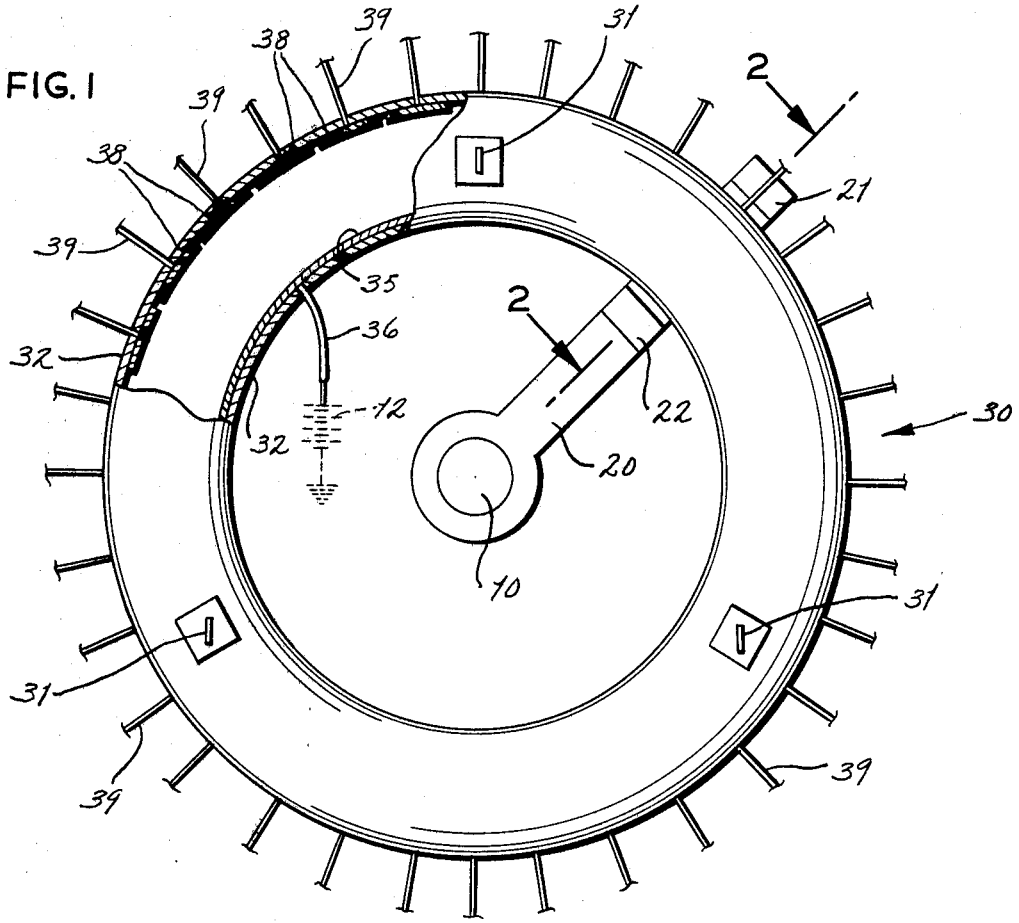
FIG. 1 is a schematic view, partially broken away, of a transducer, embodying the present invention, for indicating the angular position of a shaft.
Figure 2:
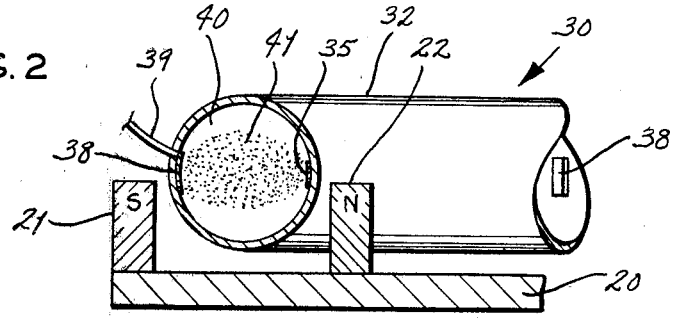
FIG. 2 is a cross-sectional view taken along line 2—2 of FIG. 1.

FIGS. 1 and 2 show schematically a preferred embodiment of the present invention useful for indicating the angular position of a rotatable element, shown for purposes of explanation as a rotatable shaft 10. Described in detail, the transducer includes a radially extending arm 20 mounted to the shaft 10. In the illustrative embodiment, two permanent bar magnets 21, 22 are mounted near the end of the arm 20, spaced from the shaft 10 and radially apart from each other, as will be described below. The outer magnet 21 is mounted with its south pole projecting perpendicularly away from the arm 20 and its north pole toward the arm 20, while the inner magnet 22 has its north pole projecting perpendicularly away from the arm 20. As will be obvious from the following description, these polarities may be reversed without change in operation. As an alternative, a single horseshoe-type magnet may be utilized in place of the two bar magnets. Each of the magnets 21, 22 may be said to trace a planar fixed circular path on rotation of the shaft 20.

The present invention further includes a hollow toroidal enclosure (hereafter toroid), generally designated 30, mounted, apart from the shaft 10 and arm 20, to stationary supporting structure, not shown. Mounting lug provisions 31, fixed to the tubular wall 32 of the toroid 30, mount the enclosure 30 in a plane parallel to the plane of the circular paths traced by the magnets 21, 22, with the central axis of the toroid 30 substantially along the axis of the shaft 10. The overall diameter of the toroid 30 and the diameter of its tubular wall 32 are such that the toroid 30 may be positioned adjacent to the circular paths traced by the magnets 21, 22, with the two magnets 21, 22 projecting along diametrically opposite sides of a section of the tubular wall 32. As shown in FIG. 2 of the embodiment illustrated, the magnets 21, 22 are of such length as to project approximately to the central plane of the toroid 30, whereby the magnetic field between the opposite poles adjacent to the tubular wall 32 will "cut" through the toroid 30.

The toroidal enclosure 30, whose tubular wall 32 is of an electrically nonconducting material, is provided with a continuous bus electrode 35 extending around the inner perimeter of and generally parallel to the plane of the toroid 30, fixed to the inner side of the tubular wall 32. An electrical lead 36 connects the bus electrode 35 to outside circuitry, shown in phantom lines in FIG. 1 as a grounded d.c. supply 12, as an example. The toroidal enclosure 30 is further provided with a chain of spaced-apart position-indicating electrodes 38, likewise generally parallel to the plane of the toroid 30, but extending around its outer perimeter, fixed to the inner side of the tubular wall 32. Each of the position-indicating electrodes 38 has an electrical lead 39 for connection to monitoring circuitry.

The toroidal enclosure 30 is sealed and contains a generally nonconductive liquid 40, such as an oil, in which is suspended a plurality of particles 41 of ferromagnetic, relatively electrically conductive particles, such as iron filings. Other particles of more conductive alloys may be substituted.

Due to the presence of the magnetic field between the magnets 21, 22, which "cuts" through the toroidal enclosure 30, the particles 41 are agglomerated into a slug or mass of conductive material which electrically couples the bus electrode 35 to one or several adjacent position-indicating electrodes 38, either by a direct conducting link or a capacitive coupling effect, as shown in FIG. 2. As the shaft 10 rotates the arm 20, the mass of particles 41 is drawn along within the toroid 30 by the magnets 21, 22. Thus, the position of the arm 20 is indicated, in the illustrative embodiment of FIGS. 1 and 2, by energization of one or more of the leads 39 of the position-indicating electrodes 38.

Figure 3:
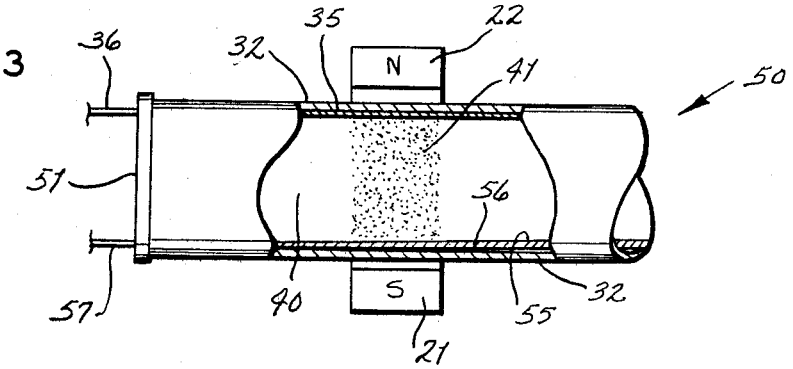
FIG. 3 is a schematic view, partially broken away, of an alternative transducer, for indicating the linear position of an element.

The law of action of the present invention may be applied to provide other apparatus for indicating the position of any element movable in a predictable path, by use of an enclosed tube mounted in fixed position apart from the movable element and extending adjacent to the fixed path of magnet means mounted to the movable element. An example of an alternative use is shown in schematic FIG. 3, where the element has a linear path; the enclosed tube 50 is linear and has end caps 51 to close and seal the ends. Magnets 21, 22 mounted on the movable element (not shown) draw the liquid-suspended mass of particles 41 along within the tube 50. A continuous bus electrode 35 with its lead 36 is utilized along one side of the tube 50, while the opposite side has an electrically resistive electrode 55 whose resistance varies progressively, such as a linear taper, along its length. The resistive electrode 55 is backed by a conductor 56 connected to a lead 57. The resistance between the two leads 36, 57 is a function of the linear position of the mass of particles 41 along the tube 50, therefore the position of the linearly movable element may be interpreted by appropriate circuitry, as will be apparent to persons skilled in the art.

For the rotary transducer, annular or toroid-like enclosures having other cross-sections may be utilized, such as square, rectangular or elliptical. Tubes or conduits of such alternative cross-sections may also be used for other types of transducers, such as the linear position transducer of FIG. 3. The magnet means mounted to the movable element may be any single magnet or group of magnets having a field of such directional polarity and intensity to agglomerate the ferromagnetic particles and draw them through the tube. From these examples, other modifications will suggest themselves to persons skilled in the art.

I claim:

1. Transducer apparatus for indicating the position of an element movable in a predictable path, comprising magnet means mounted to the movable element, whereby the magnet traces a fixed path on movement of the element in its predictable path, an enclosed conduit, the conduit being mounted in fixed position apart from the movable element and extending adjacent to the fixed path of the magnet means, and the conduit containing a liquid having suspended therein a mass of ferromagnetic, electrically conductive material, whereby the suspended mass is drawn along within the tube adjacent to the magnetic means, and further comprising electrode means, extending the length of the conduit, to monitor the position of the suspended particles.

2. The apparatus defined in claim 1, for use with a movable element whose movement is rotation about an axis, wherein the magnet means is spaced from the axis of the movable element, whereby the fixed path of the magnet means is circular, and wherein the enclosed conduit forms a toroid-like enclosure.

3. The apparatus defined in claim 2, wherein the magnet means is mounted to the movable element and spaced from its axis by an arm rotatable with the movable element.

4. The apparatus defined in claim 1, for use with a movable element whose predictable path is linear, and wherein the enclosed conduit is linear and has closed ends.

5. The apparatus defined in claim 1, wherein the electrode means includes a continuous bus electrode in the conduit wall extending substantially the length of the conduit, and a chain of spaced-apart position-indicating electrodes in the conduit wall, extending the length of the conduit and spaced transversely from the bus electrode.

6. The apparatus defined in claim 5, wherein the bus electrode and position-indicating electrodes are at the inner side of the conduit wall.

7. The apparatus defined in claim 1, wherein the electrode means includes a continuous bus electrode on the inner side of the conduit wall extending substantially the length of the conduit, a resistive electrode on the inner side of the conduit wall, extending continuously the length of the conduit and spaced transversely from the bus electrode, and a lead connected to the resistive electrode, whereby the position of the element is a function of the resistance between the bus electrode and the lead of the resistive electrode.

8. The apparatus defined in claim 1, wherein the suspended mass of electromagnetic, electrically conductive material is comprised of a plurality of individual particles, whereby the particles are agglomerated into a mass by the magnet means.

9. The apparatus defined in claim 1, wherein the magnet means is a permanent magnet.

10. The apparatus defined in claim 1, wherein the magnet means includes a pair of spaced-apart magnetic poles of opposite polarity, transversely spaced about the enclosed tube.

11. Transducer apparatus for indicating the angular position of a rotatable element having an axis of rotation, comprising magnet means, mounted to the rotatable element spaced radially outward of its axis of rotation, thereby tracing in a plane a fixed circular path on rotation of the element above its axis, a toroid-like enclosure, the enclosure having a tubular wall and the enclosure being mounted apart from the rotatable element in a plane parallel to the plane of the circular path traced by the magnet means with its central axis substantially along the axis of rotation of the rotatable element, the diameter of the toroid-like enclosure being such that its tubular wall is adjacent to the circular path traced by the magnet means, the enclosure containing a liquid having suspended therein particles of ferromagnetic, electrically-conductive material, and the wall having a bus electrode extending perimetrically around the toroid-like enclosure generally parallel to the plane of the enclosure, and a chain of spaced-apart position-indicating electrodes extending perimetrically around the toroid-like enclosure generally parallel to the plane of the enclosure and spaced transversely from the bus electrode.

* * * * *